US010052750B2

(12) United States Patent
Huang

(10) Patent No.: US 10,052,750 B2
(45) Date of Patent: Aug. 21, 2018

(54) T-BAR TYPE HAND TOOL

(71) Applicant: Chang-Sheng Huang, Taichung (TW)

(72) Inventor: Chang-Sheng Huang, Taichung (TW)

( * ) Notice: Subject to any disclaimer, the term of this patent is extended or adjusted under 35 U.S.C. 154(b) by 162 days.

(21) Appl. No.: 15/292,094

(22) Filed: Oct. 12, 2016

(65) Prior Publication Data

US 2018/0099401 A1 Apr. 12, 2018

(51) Int. Cl.

| | |
|---|---|
| ***B25G 1/00*** | (2006.01) |
| ***B25B 23/00*** | (2006.01) |
| ***B25G 1/04*** | (2006.01) |
| ***B25G 1/06*** | (2006.01) |

(52) U.S. Cl.

CPC ..... *B25G 1/005* (2013.01); *B25B 23/0007* (2013.01); *B25G 1/046* (2013.01); *B25G 1/063* (2013.01)

(58) Field of Classification Search

CPC ..... B25G 1/005; B25G 1/046; B25G 1/063; B25B 13/005; B25B 23/0007

USPC ..... 81/58.1, 177.5, 177.2

See application file for complete search history.

(56) References Cited

U.S. PATENT DOCUMENTS 2,620,001 A * 12/1952 Fratz ..... B25B 23/16 221/229
2,621,688 A * 12/1952 Wales ..... B25B 13/54 125/40
2,667,801 A * 2/1954 Eaves ..... B25B 13/466 81/177.5
3,416,395 A * 12/1968 Hanson ..... B25B 23/065 81/125
4,799,407 A * 1/1989 Miyamoto ..... B25B 13/466 81/58.1
6,240,809 B1 * 6/2001 Sasarak ..... B25B 13/461 81/58
7,040,200 B2 * 5/2006 Lin ..... B25B 13/005 81/177.5
7,082,863 B1 * 8/2006 Wang ..... B25B 23/0035 81/177.5
7,228,766 B1 * 6/2007 Shyu ..... B25B 13/005 81/125.1
7,290,468 B1 * 11/2007 Cheng ..... B25B 23/0035 81/121.1
8,528,449 B2 * 9/2013 Cheng ..... B25B 23/0021 81/177.5
2005/0274233 A1 * 12/2005 Lin ..... B25B 13/005 81/177.5
2016/0107296 A1 * 4/2016 Marcelle ..... B25B 13/505 81/98
2017/0144280 A1 * 5/2017 Shyu ..... B25B 23/1427

* cited by examiner

*Primary Examiner* — David B Thomas

(57) ABSTRACT

A T-bar type hand tool includes a first part, a second part, a rotary member, a cap and a bearing. The second part is movably extending through a through hole of the first part. The rotary member is connected to the first part. The bearing is mounted to the rotary member and the cap. When rotating the rotary member, the first part is rotated quickly.

6 Claims, 13 Drawing Sheets

T-BAR TYPE HAND TOOL

BACKGROUND OF THE INVENTION

1. Fields of the invention

The present invention relates to a T-bar type hand tool having a first part and a second part, and more particularly, to a T-bar type hand tool with a rotary member to quickly rotate the first body.

2. Descriptions of Related Art

The conventional T-bar hand tool known to applicant is disclosed in FIG. 16, and generally comprises a first part 91 and a second part 92. The first part 91 has a driving end 911 on one end thereof and is an universal connector, and a hole 912 is defined radially through the second end of the first part 91. The second part 92 movably extends through the hole 912 and is perpendicular to the first part 91. The second part 92 has a bead on each of two ends thereof. The shortcomings of the conventional T-bar hand tool is that when the object such as a bolt is not yet connected to a threaded hole, the torque applied to the bolt by the T-bar hand tool is not required significant. When rotating the T-bar hand tool, it is difficult to rotate the bolt quickly. Besides, there is only one driving portion available for being connected with the object or another hand tool, this restricts the use of the T-bar hand tool. In addition, the beads on the second part 92 are fixed and cannot be retracted into the second part 92, so that when the second part 92 moves relative to the first part 91, the bead is stopped by the periphery of the hole 912 to restrict the movement of the second part 92 relative to the first part 91 such that there will be a portion of the second part 92 protruding from the first part 91. The protruded portion of the second part 92 may hit other objects.

The present invention intends to provide a T-bar type hand tool which includes a rotary member and a cap, a bearing is located between the rotary member and the cap. The rotary member is connected to the first part. The user presses the cap and rotates the rotary member so as to quickly rotate the first part. The present invention improves the shortcomings mentioned above.

SUMMARY OF THE INVENTION

The present invention relates to a hand tool, especially to a T-bar type hand tool which comprises a first part, a second part, a rotary member, a cap and a bearing. The second part is movably extending through a through hole of the first part. The rotary member is connected to the first part. The bearing is mounted to the rotary member and the cap. When rotating the rotary member, the first part is rotated quickly.

The primary object of the present invention is to provide a T-bar type hand tool that includes a rotary member connected to the first part and the first part is connected with an object to be tightened or loosened. A cap is rotatably connected to the rotary member with a bearing located therebetween. The user presses the cap and rotates the rotary member, the first is can be rotated quickly.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
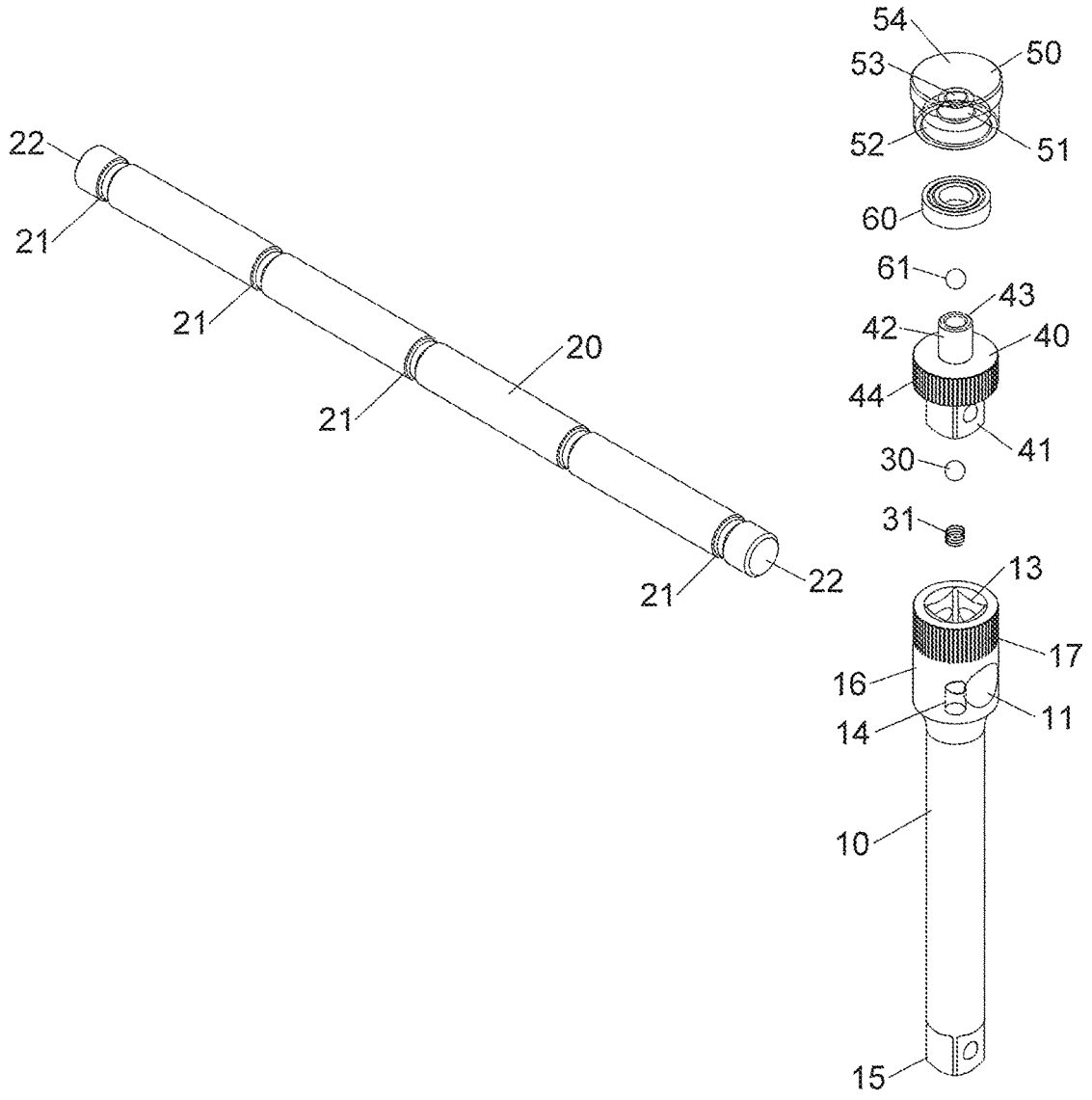
FIG. 1 is an exploded view of the hand tool of the present invention.

Referring to FIGS. 1 to 5, the hand tool of the present invention comprises a first part 10, a second part 20, a first bead 30, a first spring 31, a rotary member 40, a cap 50, a bearing 60 and a second bead 61. The first part 10 has a through hole 11 defined radially through the first end thereof and a first connection portion 13 is defined axially in the first end of the first part 10. The first connection portion 13 communicates with the through hole 11 which is a circular hole. The axis of the first connection portion 13 is perpendicular to the axis of the through hole 11. In this embodiment, the first connection portion 13 is a rectangular recess. An inner end of the first connection portion 13 has a first recess 14 defined therein. A second connection portion 15 is formed on the second end of the first part 10 and is a rectangular head. The first end of the first part 10 has an outer periphery 16 which has a first knurled portion 17 defined therein.

The second part 20 has a circular cross section and movably extends through the through hole 11. The first part 10 is perpendicular to the second part 20. The second part 20 has multiple engaging portions 21 defined in the outer periphery thereof, wherein each of the engaging portions 21 is a groove. One of the engaging portions 21 is located at the mediate portion of the second part 20. Each of the engaging portions 21 is able to be movably located corresponding to the first recess 14 when the second part 20 moves relative to the first part 10. An end face 22 is defined in each of two ends of the second part 20 and each end face 22 is a curved face. When the second part 20 moves to a position relative to the through hole 11, either of the two end faces 22 is able to be received in the through hole 11.

The first spring 31 and the first bead 30 are received in the first recess 14, and the first bead 30 is biased between the first spring 31 and one of the engaging portions 21 of the second part 20 to position the second part 20.

The rotary member 40 is removably connected to the first part 10 and has a third connection portion 41 formed on the first end thereof. The third connection portion 41 is connected to the first connection portion 13. The third connection portion 41 is identical with the second connection portion 15. The rotary member 40 has a tube 42 extending from the second end thereof, and the tube 42 has a second recess 43 defined in the distal end thereof. A second knurled portion 44 is defined between the third connection portion 41 and the tube 42. The outer diameter of the second knurled portion 44 is the same as that of the first knurled portion 17.

The cap 50 is rotatably connected to the rotary member 40 and has an opening in the first end thereof. A first room 51 is a circular room and defined in the cap 50. A second room 52 is defined in the cap 50 and communicates with the first room 51. The second room 52 is a circular room and located at the opening. The inner diameter of the second room 52 is larger than that of the first room 51. The tube 42 of the rotary member 40 extends through the second room 52 and is engaged with the first room 51. A third recess 53 is defined in the inner end of the first room 51 and located corresponding to the second recess 43. The center of the third recess 53 is located within the first room 51. The inner diameter of the third recess 53 is smaller the inner diameter of the first room 51. The first room 51 is located between the second room 52 and the third recess 53. The cap 50 has a first curved face 54 defined in the distal end thereof. The first curved face 54 is a spherical face.

The bearing 60 is shaped as a ring and mounted to the tube 42 and is accommodated in the second room 52. The inner periphery of the bearing 60 is fixed to the tube 42, and the outer periphery of the bearing 60 is fixed to the second room 52. When the rotary member 40 is rotated, the first part 10 is co-rotated. The second bead 61 is received in the second recess 43 and the third recess 53.

Figure 2:
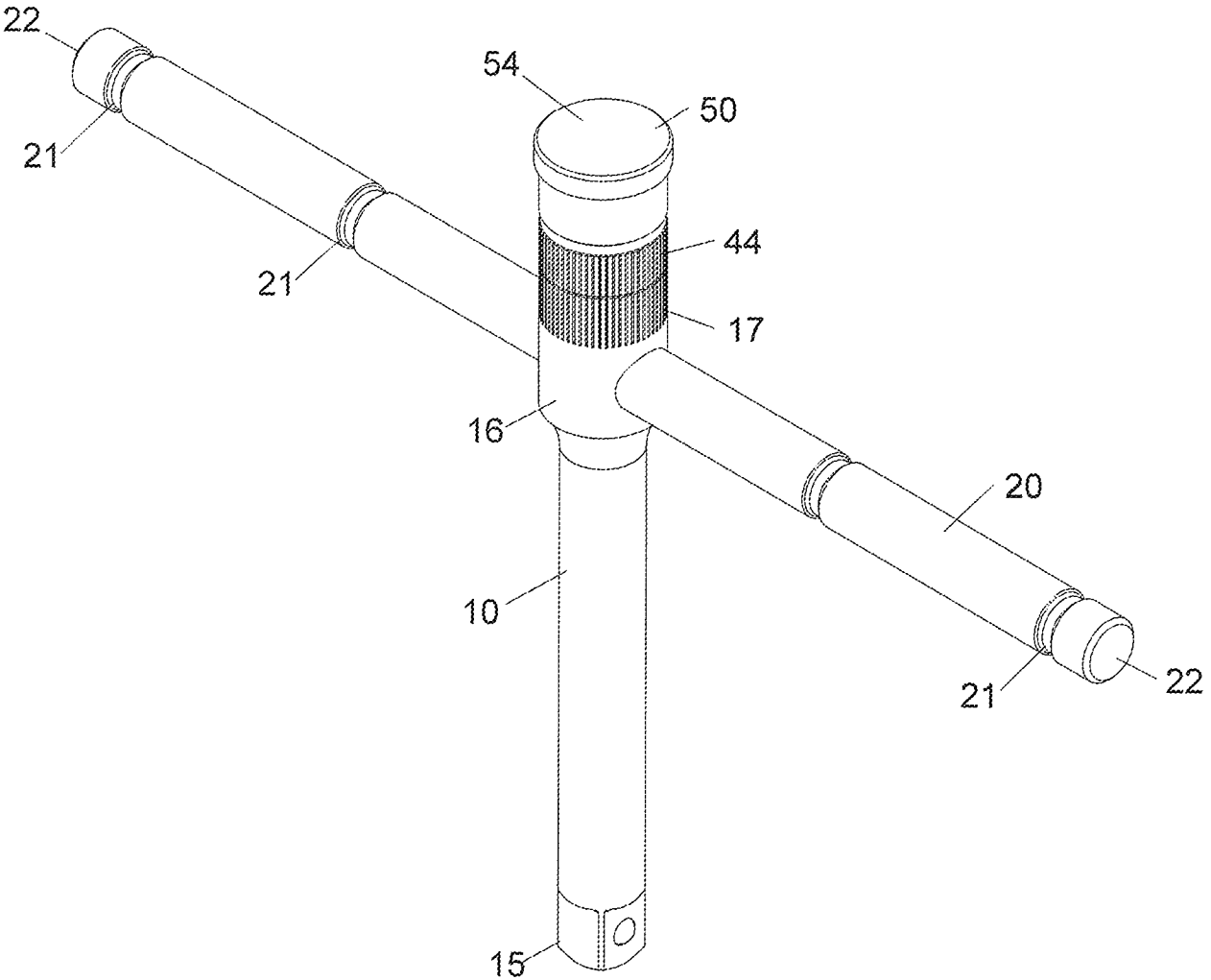
FIG. 2 is a perspective view of the hand tool of the present invention.
Figure 3:
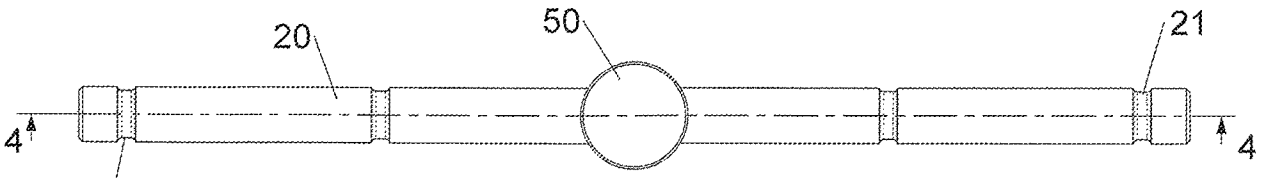
FIG. 3 is a top view of the hand tool of the present invention.
Figure 4:
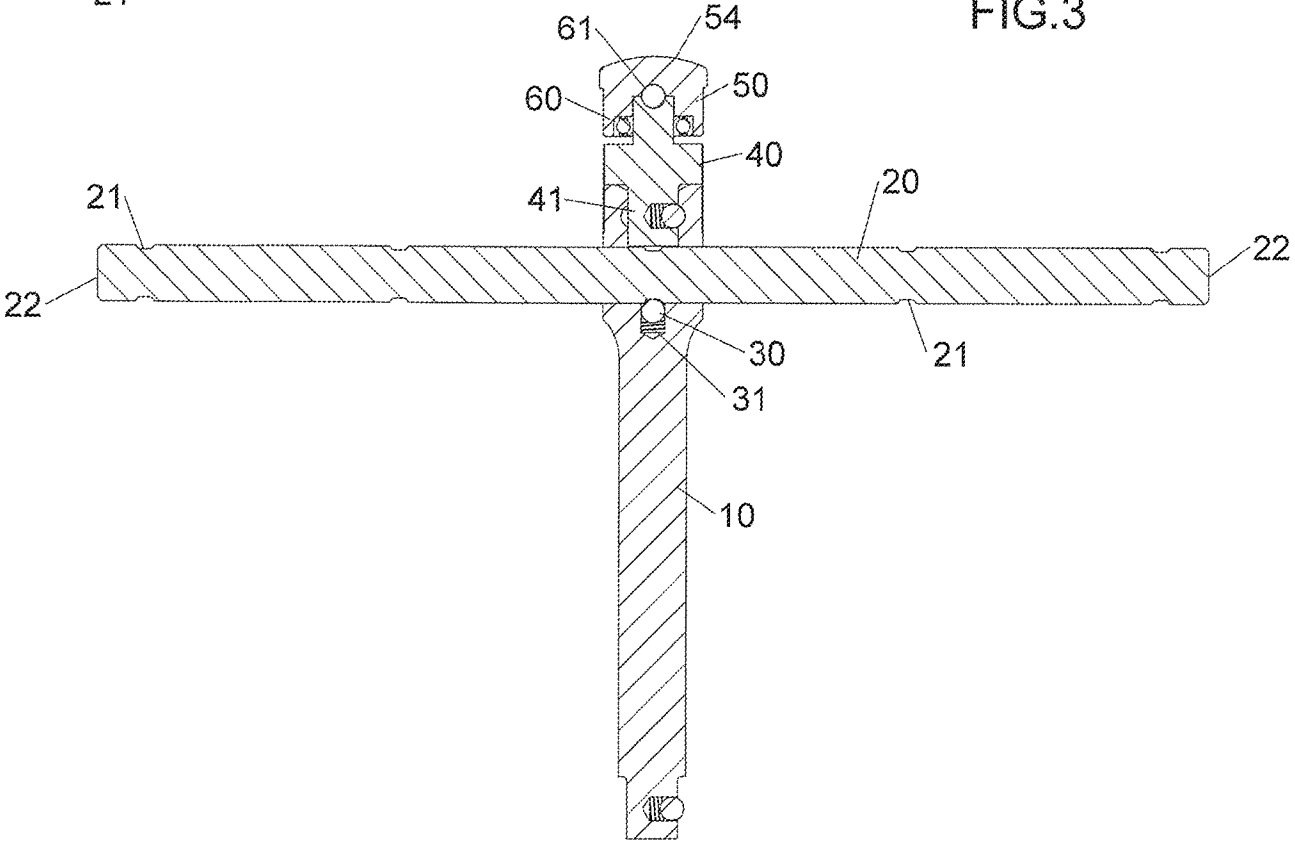
FIG. 4 is a cross sectional view, taken along line B-B in FIG. 3.

When assembling, as shown in FIG. 2, the second part 20 movably extends through the through hole 11. The first spring 31 and the first bead 30 are received in the first recess 14, and the first bead 30 is biased between the first spring 31 and one of the engaging portions 21 of the second part 20 to position the second part 20. The third connection portion 41 is connected to the first connection portion 13. The cap 50 is rotatably connected to the rotary member 40. The bearing 60 is mounted to the tube 42 and is accommodated in the second room 52. The second bead 61 is received in the second recess 43 and the third recess 53.

Figure 5:
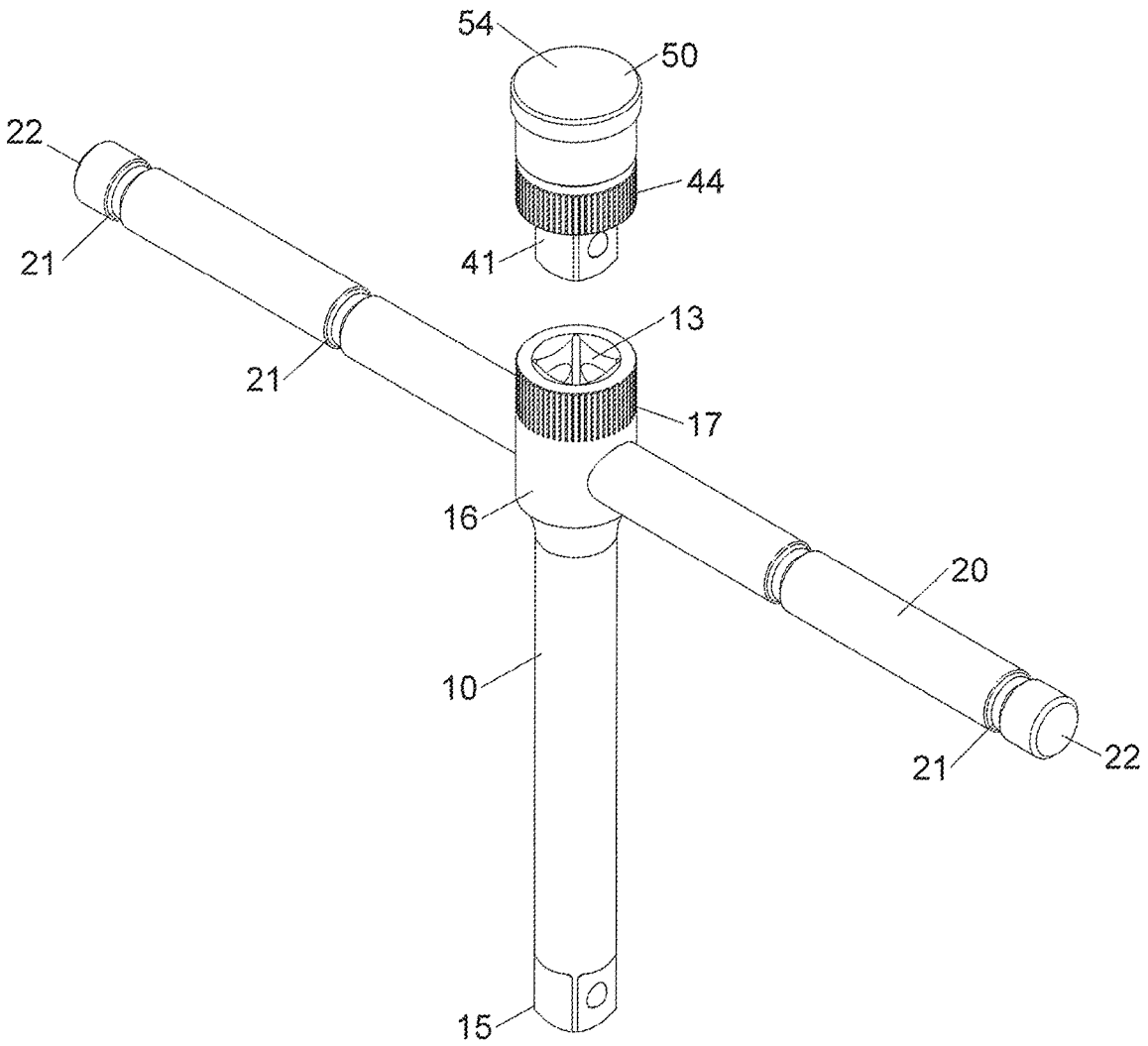
FIG. 5 shows the operational status of the hand tool of the present invention.

As shown in FIG. 5, the rotary member 40 is able to be separated from the first connection portion 13. The rotary member 40, the cap 50 and the bearing 60 can be used as a tool to quickly rotate an object. The first and second parts 10, 20 are used as another tool.

Figure 6:
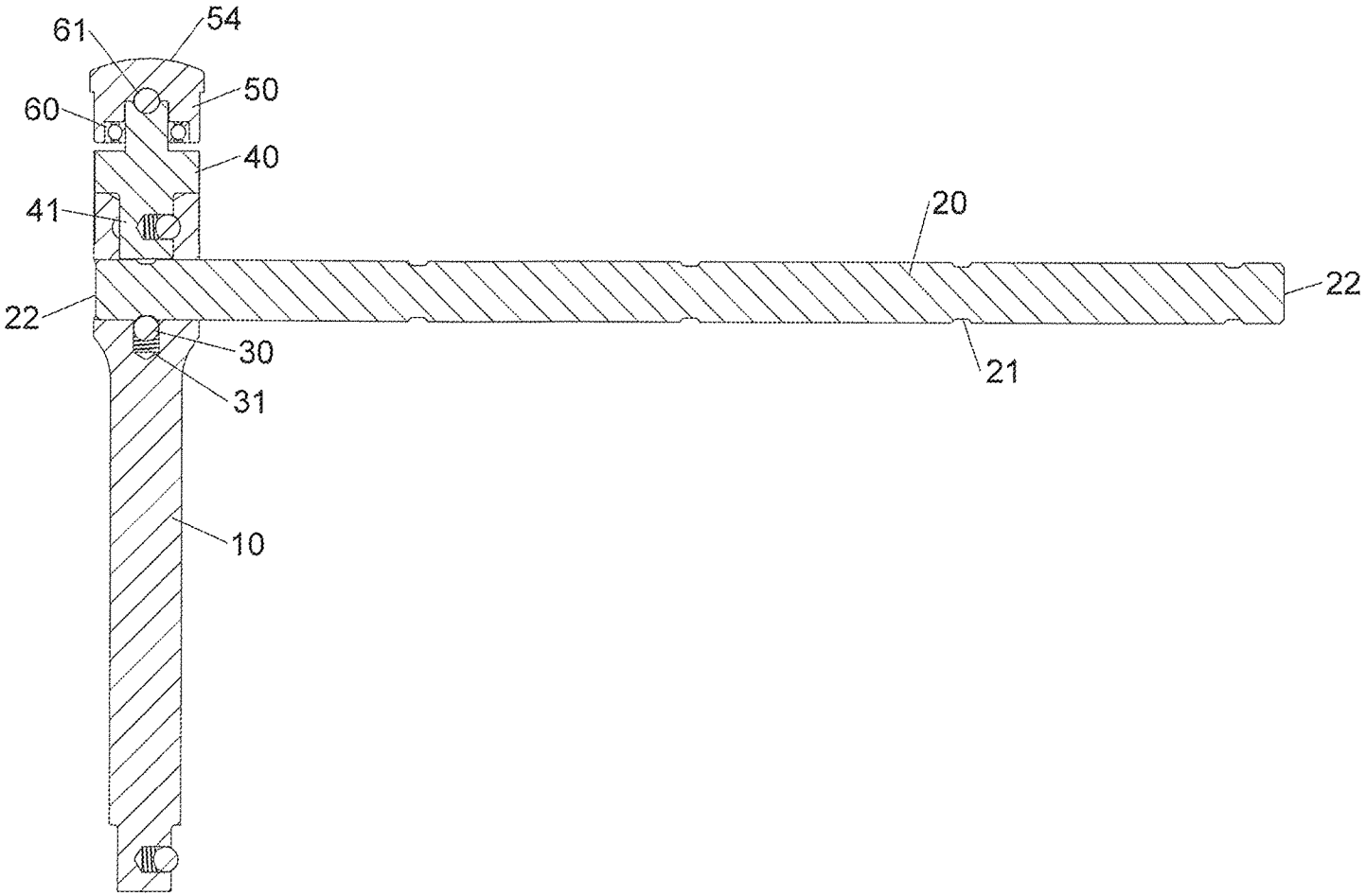
FIG. 6 shows another operational status of the hand tool of the present invention.

As shown in FIG. 6, the second part 20 is movable relative to the first part 10. Either of the end faces 22 can be received in the through hole 11. When the first bead 30 is engaged with the engaging portion 21 that is located close to the end face 22, the second part 20 is not separated from the first part 10 because of the first bead 30. The first and second parts 10, 20 form an L-shaped tool.

Figure 7:
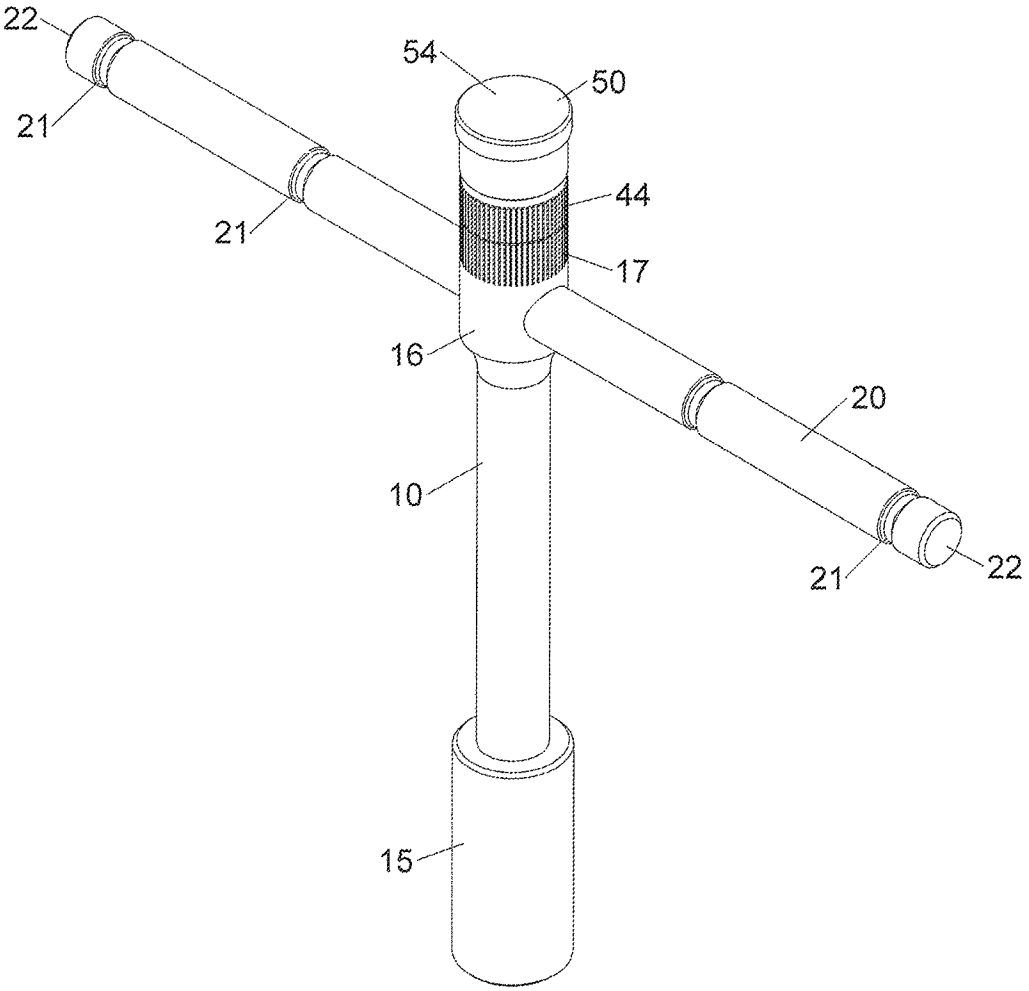
FIG. 7 is a perspective view of the second embodiment of the hand tool of the present invention.
Figure 8:
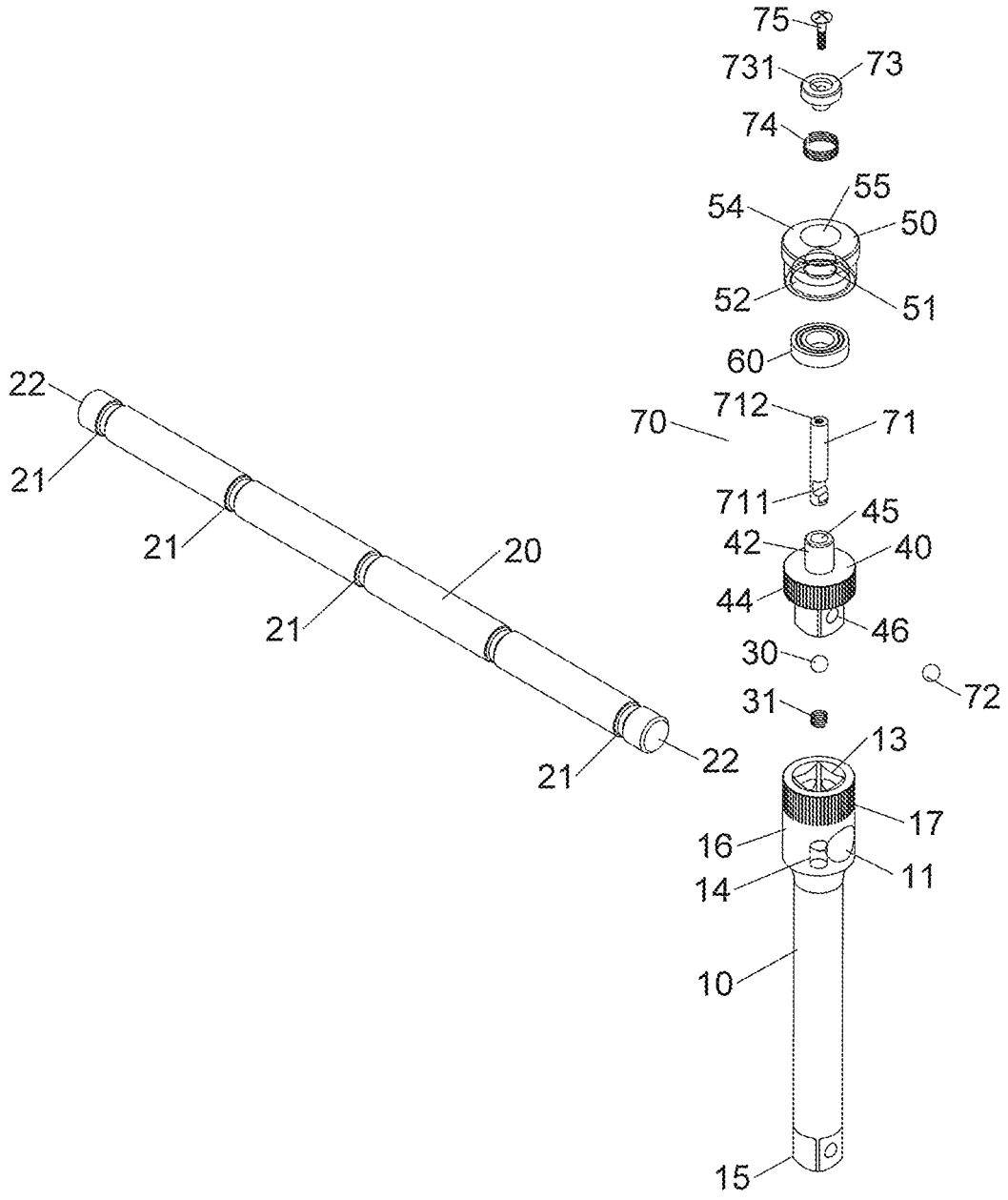
FIG. 8 is an exploded view of the third embodiment of the hand tool of the present invention.
Figure 9:
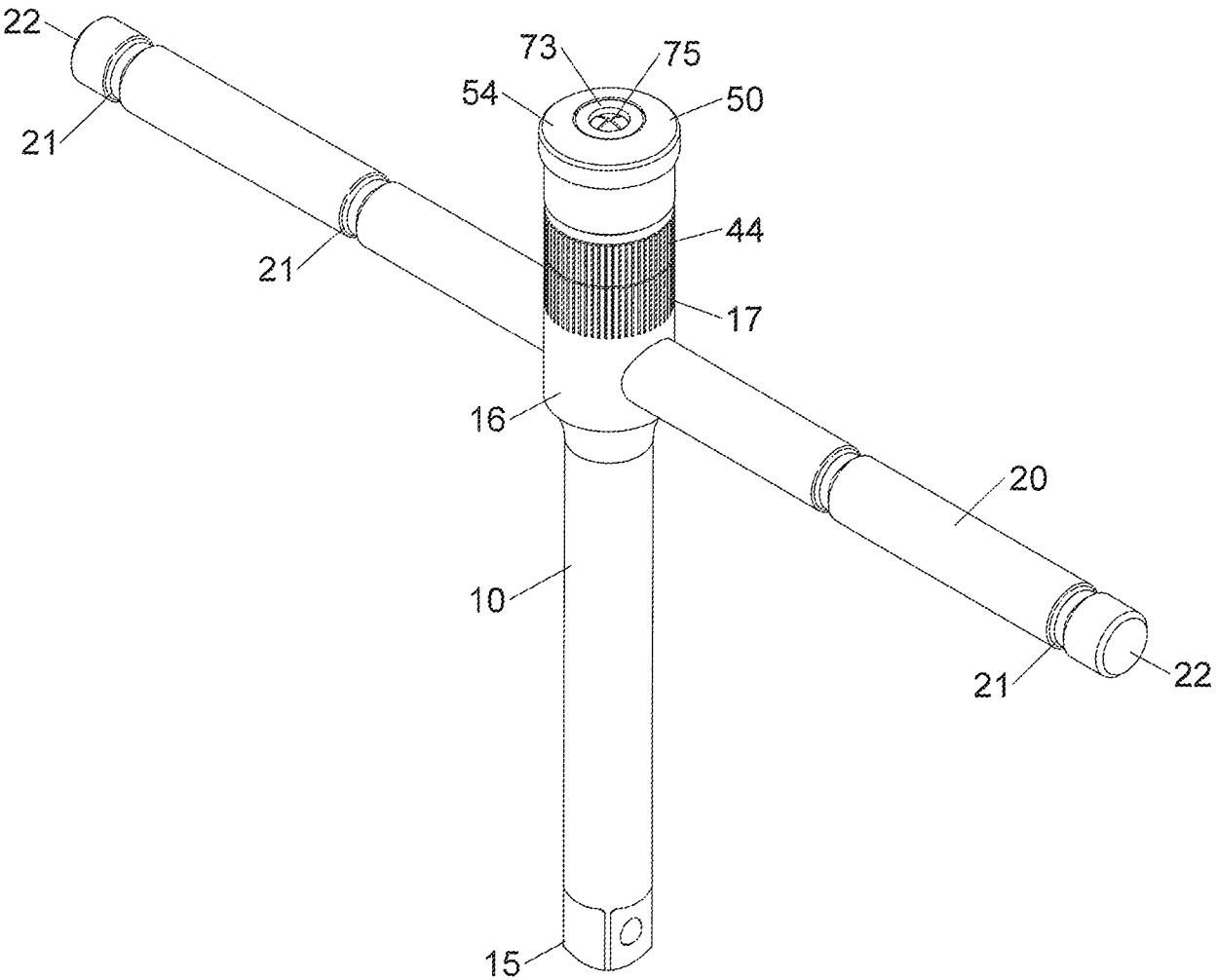
FIG. 9 is a perspective view of the third embodiment of the hand tool of the present invention.
Figure 10:
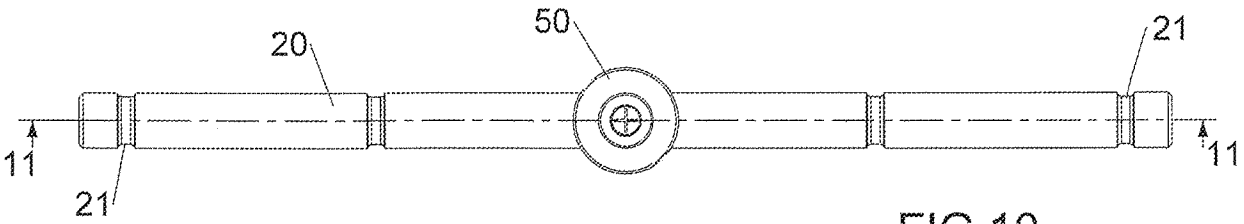
FIG. 10 is a top view of the third embodiment of the hand tool of the present invention.
Figure 11:
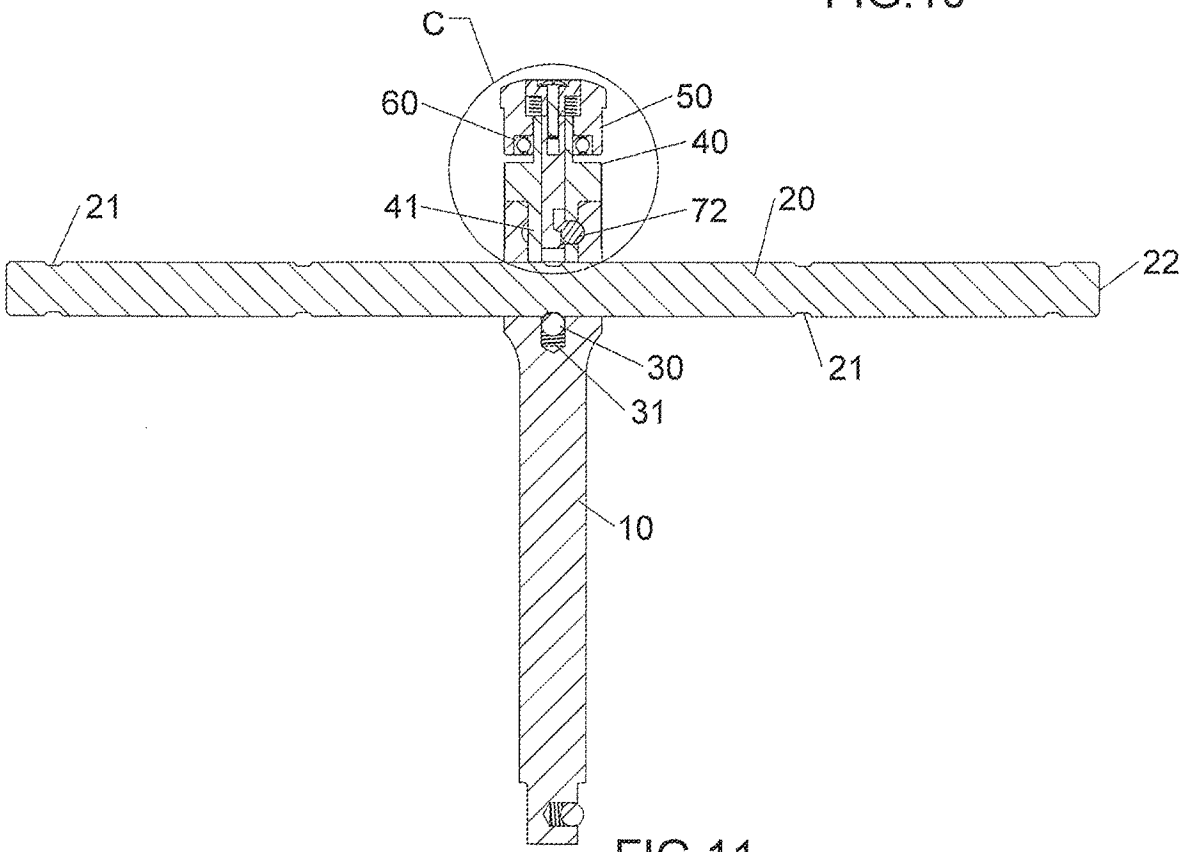
FIG. 11 is a cross sectional view, taken along line B-B in FIG. 10.
Figure 12:
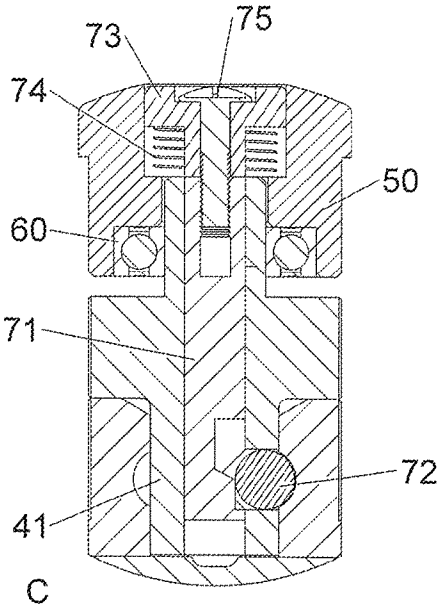
FIG. 12 is an enlarged view of the circle "C" in FIG. 11.

As shown in FIG. 7, the second connection portion 15 is a polygonal recess so as to be connected with an object or tool having a polygonal head.

As shown in FIGS. 8 to 12, the rotary member 40 does not have the second recess 43. the rotary member 40 has a first passage 45 defined axially therethrough. The third connection portion 41 has a fourth recess 46 which communicates with the first passage 45. The cap 50 does not have the third recess 53. A second passage 55 is defined in the second end of the cap 50 and communicates with the first room 51 and the second room 52. The inner diameter of the second passage 55 is larger than the inner diameter of the first room 51. A press unit 70 is connected to the cap 50 and has a rod 71, a third bead 72, a head member 73, a second spring 74 and a screw 75. The rod 71 extends through the first passage 45 and has a notch 711 defined in the outer periphery of the first end thereof. The notch 711 has a first position and a second position. The rod 71 is movable in the first passage 45 to respectively align the first position and the second position of the notch 711 with the fourth recess 46 of the rotary member 40. The rod 71 has a threaded portion 712 defined in the second end thereof. The third bead 72 is received in the first position of the notch 711 and partially protrudes beyond the fourth recess 46. The head member 73 is received in the second passage 55 and connected to the rod 71. The head member 73 has a hole 731 which is located corresponding to the threaded portion 712. The second spring 74 is received in the second passage 55 and mounted to the head member 73. The second spring 74 is biased between the inner end of the second passage 55 and the head member 73. The second spring 74 is a coil spring or a cone-shaped spring. The screw 75 extends through the hole 731 of the head member 73 and is threadedly connected to the threaded portion 712 to connect the rod 71 to the head member 73.

Figure 13:
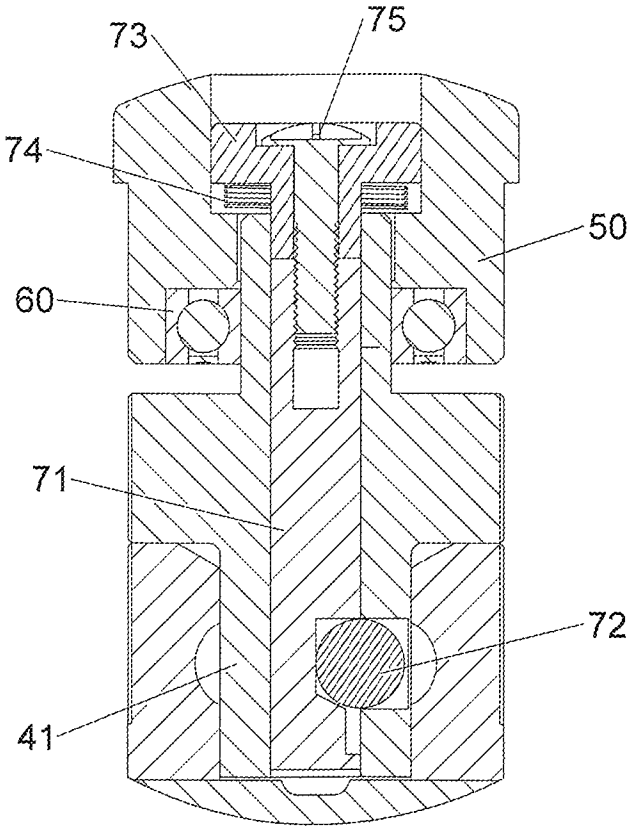
FIG. 13 shows another operational status of the circle "C" in FIG. 11.

As shown in FIG. 13, when the user presses the press unit 70, the head member 73 moves and compresses the second spring 74. The head member 73 also moves the rod 71 within the first passage 45. The third bead 72 is located at the second position of the notch 711, the third bead 72 is merged in the fourth recess 46, so that the third connection portion 43 can be separated from the first connection portion 13.

Figure 14:
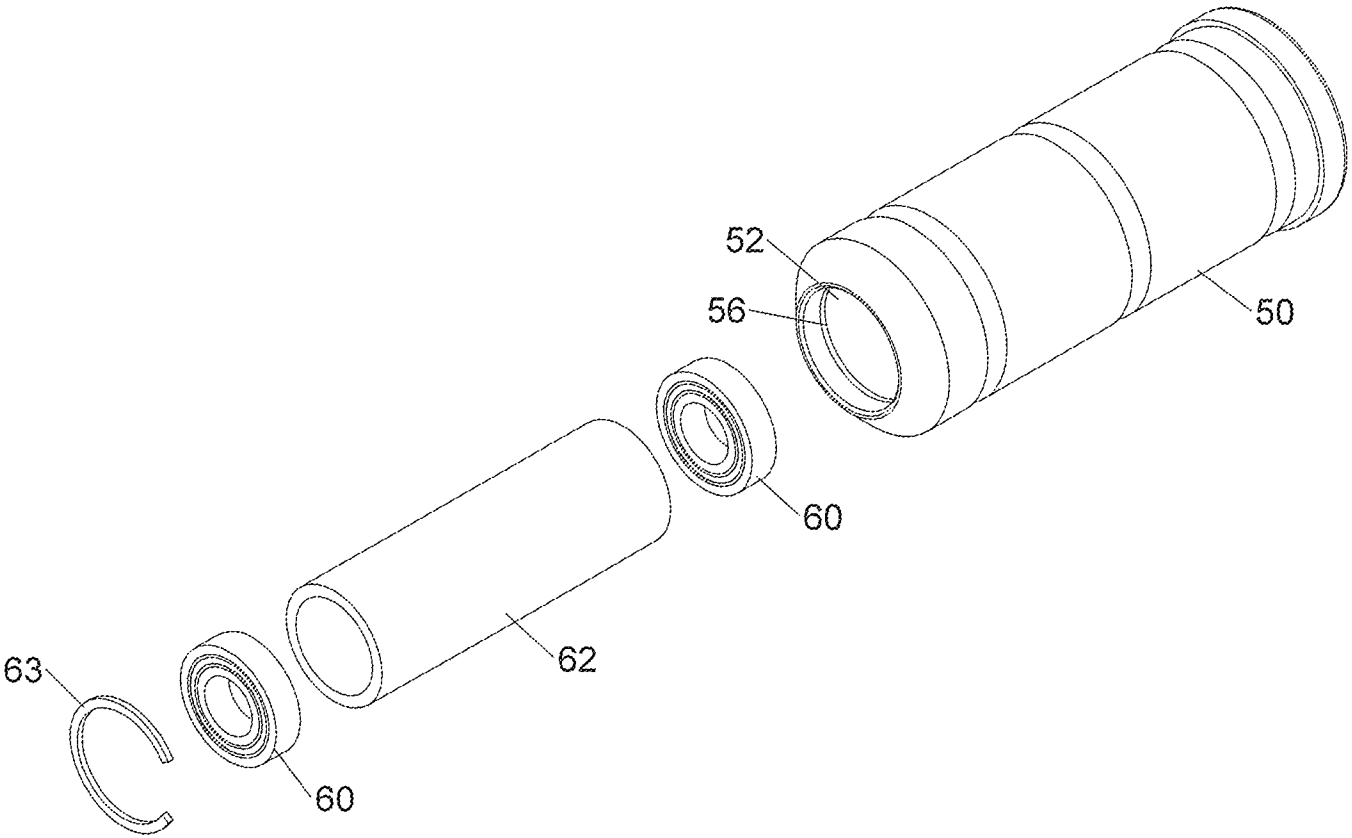
FIG. 14 shows a portion of the parts of the fourth embodiment of the hand tool of the present invention.
Figure 15:
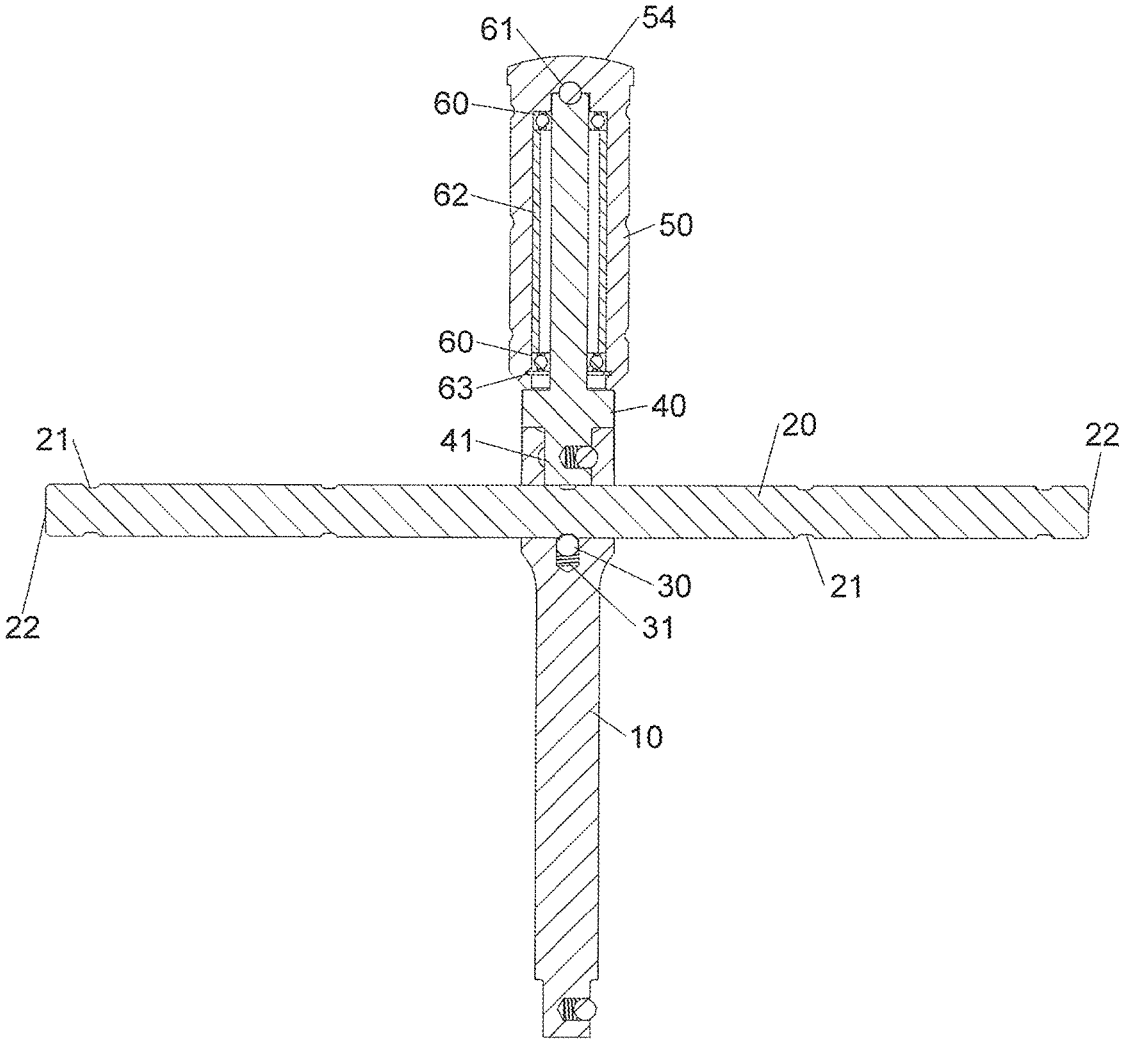
FIG. 15 is a cross sectional view of the fourth embodiment of the present invention.

As shown in FIGS. 14 and 15, the length of the tube 42 is longer than that disclosed in FIG. 1, and the length of the cap 50 is also longer than that disclosed in FIG. 1. the second room 52 includes an engaging groove 56 defined in the inner periphery thereof and located close to the opening of the cap 50. There are two bearings 60 which are respectively received in two ends of the second room 52 and mounted to the tube 42. A sleeve 62 is located between the two bearings 60 and received in the second room 52. A clip 63 is engaged with the engaging groove 56 to restrict the bearings 60 and the sleeve 62 from dropping from the second room 52.

In another embodiment, the second part 20 and the first part 10 are an integral part. In other words, the first part 10 does not have the through hole 11, and the second part 40 is directly connected to the first part 10.

In yet another embodiment, the rotary member 40 and the first part 10 are an integral part. In other words, the first part 10 does not have the first connection portion 13, and the tube 42 and the second recess 43 are directly formed to the first part 10.

In a further embodiment, the first connection portion 13 is a hexagonal recess, and the third connection portion 41 is a hexagonal head.

Figure 16:
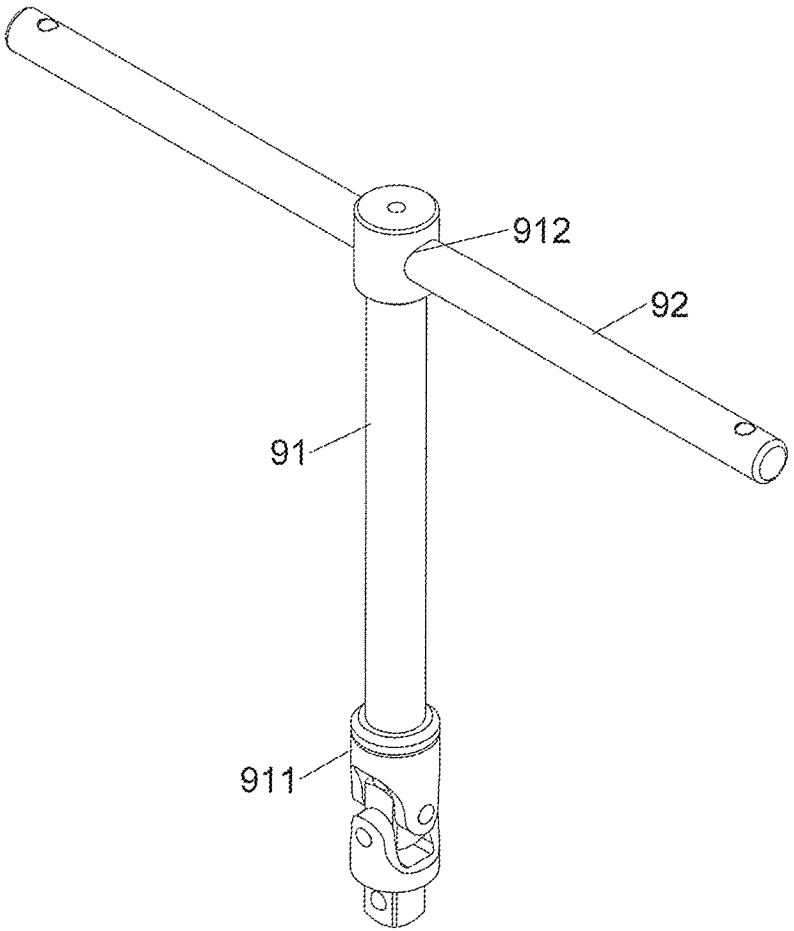
PRIOR ART FIG.16
FIG. 16 shows the conventional T-bar hand tool.

In another embodiment, the second connection portion 15 is a rectangular head as shown in FIG. 1, or a hexagonal recess as shown in FIG. 7. The second connection portion 15 can also be an universal connector as shown in FIG. 16.

The advantages of the present invention are that the bearing 60 is mounted to the tube 42 and received in the second room 52. The user's palm presses the curved face 54 and the user holes the second knurled portion 44 to rotate the rotary member 40, so that the first part 10 can be rotated quickly.

Generally, when tightening or loosening a bolt that is deeply threaded into the threaded hole, a significant torque is needed to rotate the bolt. However, when the bolt is not yet deeply threaded into the threaded hole, the user simply presses the cap 50 and rotates the rotary member 40 quickly to rotate the first part 10, such that the bolt can quickly connected to the threaded hole or removed from the threaded hole.

As shown in FIG. 5, the rotary member 40 is removed from the first connection portion 13 of the first part 10, the rotary member 40, the cap 50 and the bearing 60 can be used as a tool, and the first and the second parts 10, 20 are used an another tool.

The bearing 60 provides support on the horizontal direction, and the second bead 61 provides support on the upright direction, so that the cap 50 is smoothly rotatable relative to the rotary member 40.

As shown in FIG. 6, the second part 20 is movable relative to the first part 10. Either of the end faces 22 can be received in the through hole 11. When the first bead 30 is engaged with the engaging portion 21 that is located close to the end face 22, the second part 20 is not separated from the first part 10 because of the first bead 30. The first and second parts 10, 20 form an L-shaped tool. The end face 22 is able to be received in the through hole 11, so that when the hand tool rotates, the end face 22 does not hit other parts.

As shown in FIG. 13, when the user presses the press unit 70, the head member 73 moves and compresses the second spring 74. The head member 73 also moves the rod 71 within the first passage 45. The third bead 72 is located at the second position of the notch 711, the third bead 72 is merged in the fourth recess 46, so that the third connection portion 43 can be separated from the first connection portion 13.

As shown in FIG. 14, the longer tube 42 and the cap 50 provide better grip for the users so that the user can hold the cap 50 and quickly rotate the second part 20.

While we have shown and described the embodiment in accordance with the present invention, it should be clear to those skilled in the art that further embodiments may be made without departing from the scope of the present invention.

What is claimed is:

1. A hand tool comprising:

a first part having a through hole defined radially through a first end thereof and a first connection portion defined axially in the first end of the first part, the first connection portion communicating with the through hole which is a circular hole, an axis of the first connection portion being perpendicular to an axis of the through hole, the first connection portion being a rectangular recess, an inner end of the first connection portion having a first recess defined therein, a second connection portion formed on a second end of the first part and being a rectangular head, the first end of the first part having an outer periphery which has a first knurled portion defined therein;

a second part having a circular cross section and movably extending through the through hole, the first part being perpendicular to the second part, the second part having multiple engaging portions defined in an outer periphery thereof, each of the engaging portions being a groove, one of the engaging portions located at a mediate portion of the second part, each of the engaging portions being movably located corresponding to the first recess, an end face defined in each of two ends of the second part and being a curved face, when the second part moves to a position relative to the through hole, either of the two end faces is received in the through hole;

a first spring and a first bead received in the first recess, the first bead being biased between the first spring and one of the engaging portions of the second part to position the second part;

a rotary member removably connected to the first part and having a third connection portion formed on a first end thereof, the third connection portion connected to the first connection portion, the third connection portion being identical with the second connection portion, the rotary member having a tube extending from a second end thereof, the tube having a second recess defined in a distal end thereof, a second knurled portion defined between the third connection portion and the tube, an outer diameter of the second knurled portion being the same as that of the first knurled portion;

a cap rotatably connected to the rotary member and having an opening in a first end thereof, a first room being a circular room defined in the cap, a second room defined in the cap and communicating with the first room, the second room being a circular room and located at the opening, an inner diameter of the second room being larger than that of the first room, the tube of the rotary member 40 extending through the second room and is engaged with the first room, a third recess defined in an inner end of the first room and located corresponding to the second recess, a center of the third recess located within the first room, an inner diameter of the third recess being smaller the inner diameter of the first room, the first room located between the second room and the third recess, the cap having a first curved face defined in a distal end thereof, the first curved face being a spherical face;

a bearing being shaped as a ring and mounted to the tube and accommodated in the second room, an inner periphery of the bearing fixed to the tube, an outer periphery of the bearing fixed to the second room, when the rotary member is rotated, the first part is co-rotated, and a second bead received in the second recess and the third recess.

2. The hand tool as claimed in claim 1, wherein the second connection portion is a polygonal recess.

3. The hand tool as claimed in claim 1, wherein the rotary member has a first passage defined axially therethrough, the third connection portion has a fourth recess which communicates with the first passage, a second passage is defined in a second end of the cap and communicates with the first room and the second room, an inner diameter of the second passage is larger than the inner diameter of the first room, a press unit connected to the cap and having a rod, a third bead, a head member, a second spring and a screw, the rod extends through the first passage and has a notch defined in an outer periphery of a first end thereof, the notch having a first position and a second position, the rod is movable in the first passage to respectively align the first position and the second position of the notch with the fourth recess of the rotary member, the rod has a threaded portion defined in a second end thereof, the third bead is received in the first position of the notch and partially protrudes beyond the fourth recess, the head member is received in the second passage and connected to the rod, the head member has a hole which is located corresponding to the threaded portion, the second spring is received in the second passage and mounted to the head member, the second spring is biased between an inner end of the second passage and the head member, the second spring is a coil spring or a cone-shaped spring, the screw extends through the hole of the head member and is threadedly connected to the threaded portion to connect the rod to the head member.

4. The hand tool as claimed in claim 1, wherein the second room includes an engaging groove defined in the inner periphery thereof and located close to the opening of the cap, there are two bearings which are respectively received in two ends of the second room and mounted to the tube, a sleeve is located between the two bearings and received in the second room, a clip is engaged with the engaging groove to restrict the sleeve from dropping from the second room.

5. The hand tool as claimed in claim 1, wherein the first connection portion is a hexagonal recess, the third connection portion is a hexagonal head.

6. The hand tool as claimed in claim 1, wherein the first connection portion is a hexagonal head, the third connection portion is a hexagonal recess.

* * * * *